US008505877B2

(12) United States Patent
Strohmeier

(10) Patent No.: US 8,505,877 B2
(45) Date of Patent: Aug. 13, 2013

(54) RESCUE DEVICE WITH SPREADING MECHANISM

(75) Inventor: Kurt Strohmeier, Aschach/Steyr (AT)

(73) Assignee: Weber-Hydraulik GmbH (AT)

( * ) Notice: Subject to any disclaimer, the term of this patent is extended or adjusted under 35 U.S.C. 154(b) by 926 days.

(21) Appl. No.: 12/514,146

(22) PCT Filed: Nov. 8, 2007

(86) PCT No.: PCT/AT2007/000505

§ 371 (c)(1),
(2), (4) Date: Sep. 9, 2009

(87) PCT Pub. No.: WO2008/055280

PCT Pub. Date: May 15, 2008

(65) Prior Publication Data

US 2010/0025647 A1 Feb. 4, 2010

(30) Foreign Application Priority Data

Nov. 8, 2006 (AT) ..... GM799/2006 U

(51) Int. Cl.
*A62B 3/00* (2006.01)

(52) U.S. Cl.
USPC ..... 254/104; 254/124; 254/93 R; 72/392

(58) Field of Classification Search
USPC ..... 254/104, 124, 93 H, 93 R, 94; 29/252; 81/301, 302, 349, 383.5; 72/392, 705; 228/262.5
See application file for complete search history.

(56) References Cited

U.S. PATENT DOCUMENTS

| | | | | | |
|---|---|---|---|---|---|
| 1,930,463 | A | * | 10/1933 | Archer | 428/649 |
| 2,296,173 | A | * | 9/1942 | Mandl | 72/392 |
| 2,341,278 | A | * | 2/1944 | Long | 72/392 |
| 3,749,365 | A | * | 7/1973 | Van Gompel | 254/104 |
| 3,819,153 | A | * | 6/1974 | Hurst et al. | 254/93 R |
| 4,299,860 | A | * | 11/1981 | Schaefer et al. | 427/556 |
| 4,392,263 | A | * | 7/1983 | Amoroso | 7/100 |
| 4,506,445 | A | * | 3/1985 | Esten | 30/228 |
| 4,531,289 | A | | 7/1985 | Brick | |
| 4,832,982 | A | * | 5/1989 | Mori et al. | 427/597 |
| 4,842,249 | A | * | 6/1989 | Weigand | 254/93 R |

(Continued)

FOREIGN PATENT DOCUMENTS

| | | |
|---|---|---|
| AT | 411592 | 3/2004 |
| AU | 2006201881 | 12/2006 |

(Continued)

OTHER PUBLICATIONS

International Search Report, PCT/AT2007/000505.

*Primary Examiner* — Lee D Wilson
*Assistant Examiner* — Tyrone V Hall, Jr.
(74) *Attorney, Agent, or Firm* — Lerner, David, Littenberg, Krumholz & Mentlik, LLP

(57) ABSTRACT

The invention describes a rescue apparatus (1) with prising arms (4, 5) on a support housing (3) mounted in at least one pivot bearing arrangement (20) with a drive system (2) so as to be displaceable in pincer-like movement about a pivot axis (17) extending perpendicular to a longitudinal mid-axis (18) of the support housing (3). Surface regions (41) with a higher resistance to wear than the resistance to wear of adjacent regions (42) are provided on at least mutually facing internal surfaces (26, 27) of the prising arms (4, 5).

7 Claims, 4 Drawing Sheets

(56) References Cited

U.S. PATENT DOCUMENTS

| | | | | | |
|---|---|---|---|---|---|
| 4,869,465 | A | * | 9/1989 | Yirmiyahu et al. | 254/93 R |
| 4,973,028 | A | * | 11/1990 | Linster | 254/93 R |
| 5,449,536 | A | * | 9/1995 | Funkhouser et al. | 427/597 |
| 5,544,862 | A | * | 8/1996 | Hickerson | 254/124 |
| 5,656,992 | A | * | 8/1997 | McNeill | 340/441 |
| 5,956,992 | A | * | 9/1999 | Patton | 72/392 |
| 6,000,680 | A | * | 12/1999 | Kimura et al. | 254/93 R |
| 6,074,497 | A | * | 6/2000 | Inoue et al. | 148/403 |
| 6,244,568 | B1 | * | 6/2001 | Patton | 254/93 R |
| 6,311,537 | B1 | * | 11/2001 | Vigil | 72/392 |
| 7,100,373 | B2 | * | 9/2006 | Oide | 60/477 |
| 7,107,812 | B1 | * | 9/2006 | Patton et al. | 72/392 |
| 2006/0086708 | A1 | * | 4/2006 | Coleman et al. | 219/137 WM |

FOREIGN PATENT DOCUMENTS

| | | | | |
|---|---|---|---|---|
| EP | 76644 | A2 | * | 4/1983 |
| EP | 1726409 | | | 11/2006 |
| GB | 2254580 | | | 10/1992 |
| GB | 2254580 | A | * | 10/1992 |

* cited by examiner

RESCUE DEVICE WITH SPREADING MECHANISM

CROSS REFERENCE TO RELATED APPLICATIONS

The present application is a national phase entry under 35 U.S.C. §371 of International Application No. PCT/AT2007/000505, filed 8 Nov. 2007, published in German, which claims the benefit of Austrian Patent Application No. GM 799/2006, filed 8 Nov. 2008. The disclosures of these applications are incorporated by reference herein.

BACKGROUND OF THE INVENTION

The invention relates to a rescue apparatus.

Document AT 411 592 B filed by this same applicant discloses a prising device with a linear drive system which can be pressurised by means of a pressurising medium in order to drive pivotably mounted prising arms mounted in a housing of the prising device in a complementary synchronous arrangement, and the drive system has a ram arrangement for transmitting a synchronous driving motion from the linear drive system to the pivotably mounted prising arms. Disposed in the end regions of the prising arms are prising tips of different designs which can be changed to suit a particular application.

Specifications U.S. Pat. Nos. 1,531,289 A, 6,311,537 B1 and GB 2 254 580 disclose rescue apparatus of the generic type, and replaceable anti-wear elements in the form of interchangeable tips or cutting blades are provided at the points of the prising arms subjected to the highest loads.

BRIEF SUMMARY OF THE INVENTION

The objective of the invention is to propose a rescue apparatus with prising arms which can be operated in the manner of pincers, which have a high resistance to wear in the region of surfaces which act on objects and afford a high resistance to counteract slipping.

This objective is achieved by the invention on the basis of the features defined in the embodiments of the present invention. The surprising advantage of this approach is that by partially increasing wear resistance, it is possible to use materials with a low weight which generally also have a low resistance to wear, thereby significantly improving manipulating conditions.

In this respect, embodiments such as described in accordance with the present invention are of advantage, whereby in addition to obtaining high durability, objects to be deformed can be gripped without them slipping and they can be safely manipulated during operation.

The embodiment described in accordance with the present invention makes for economic use of the material and saves on expensive finishing work.

The embodiment described in accordance with the present invention advantageously results in a long service life and enables the rescue apparatus to be rapidly adapted to suit the respective situation.

The advantageous embodiments described in accordance with the present invention enable universal application of the rescue apparatus irrespective of the geometric properties of an object.

The embodiments defined in accordance with the present invention are also of advantage because hard substances can be introduced into an Al matrix without causing embrittlement and tearing of the base material.

Finally, the embodiments defined in accordance with the present invention are also of advantage because another variant of a technically high-quality and inexpensive fitting of a prising arm ensues a long service life.

BRIEF DESCRIPTION OF THE DRAWINGS

To provide a clearer understanding, the invention will be explained in more detail below with reference to embodiments illustrated in the appended drawings.

DETAILED DESCRIPTION OF THE PREFERRED EMBODIMENTS

Figure 1:
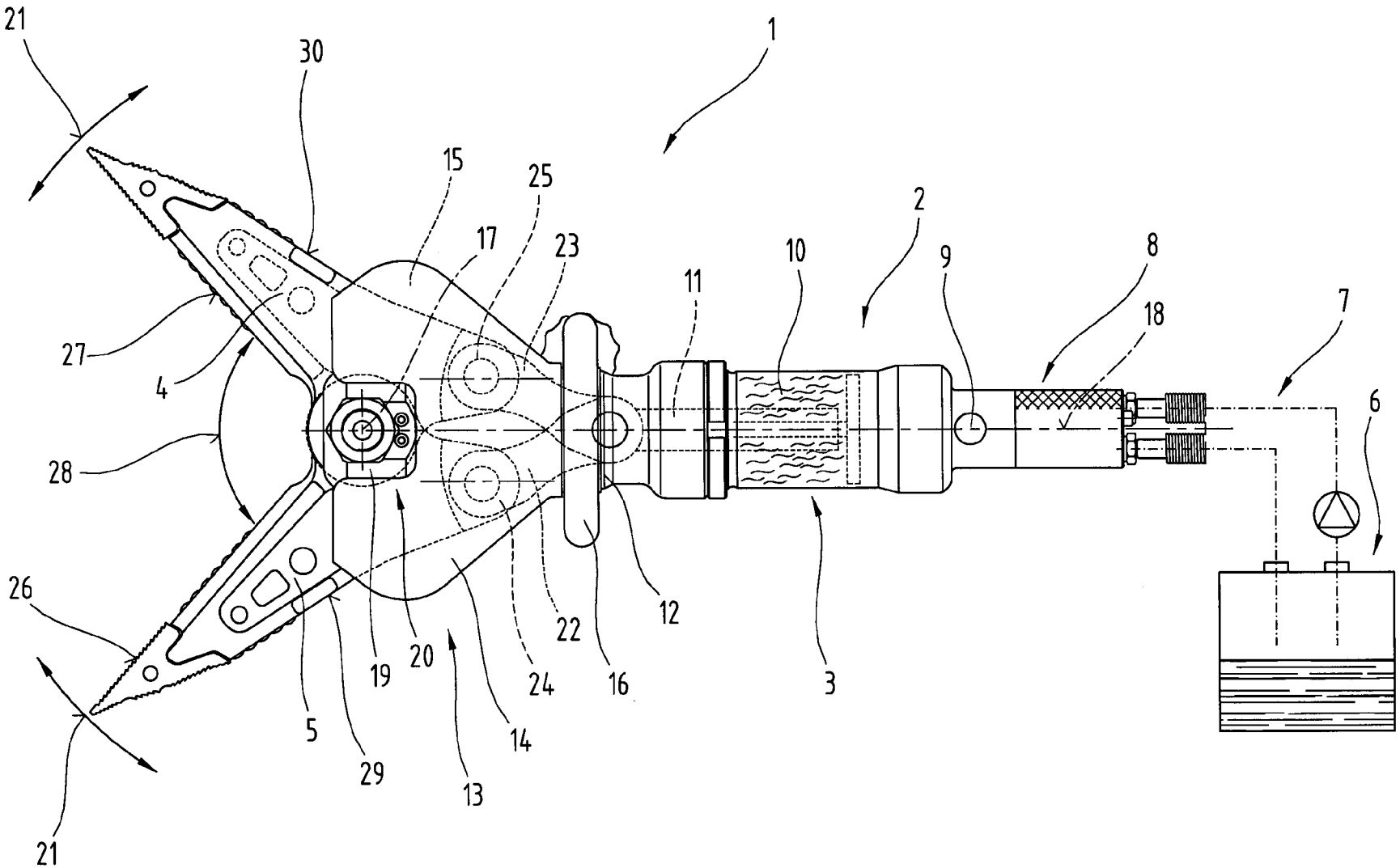
FIG. 1 is a front view of the rescue apparatus proposed by the invention.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

All the figures relating to ranges of values in the description should be construed as meaning that they include any and all part-ranges, in which case, for example, the range of 1 to 10 should be understood as including all part-ranges starting from the lower limit of 1 to the upper limit of 10, i.e. all part-ranges starting with a lower limit of 1 or more and ending with an upper limit of 10 or less, e.g. 1 to 1.7, or 3.2 to 8.1 or 5.5 to 10.

Figure 2:
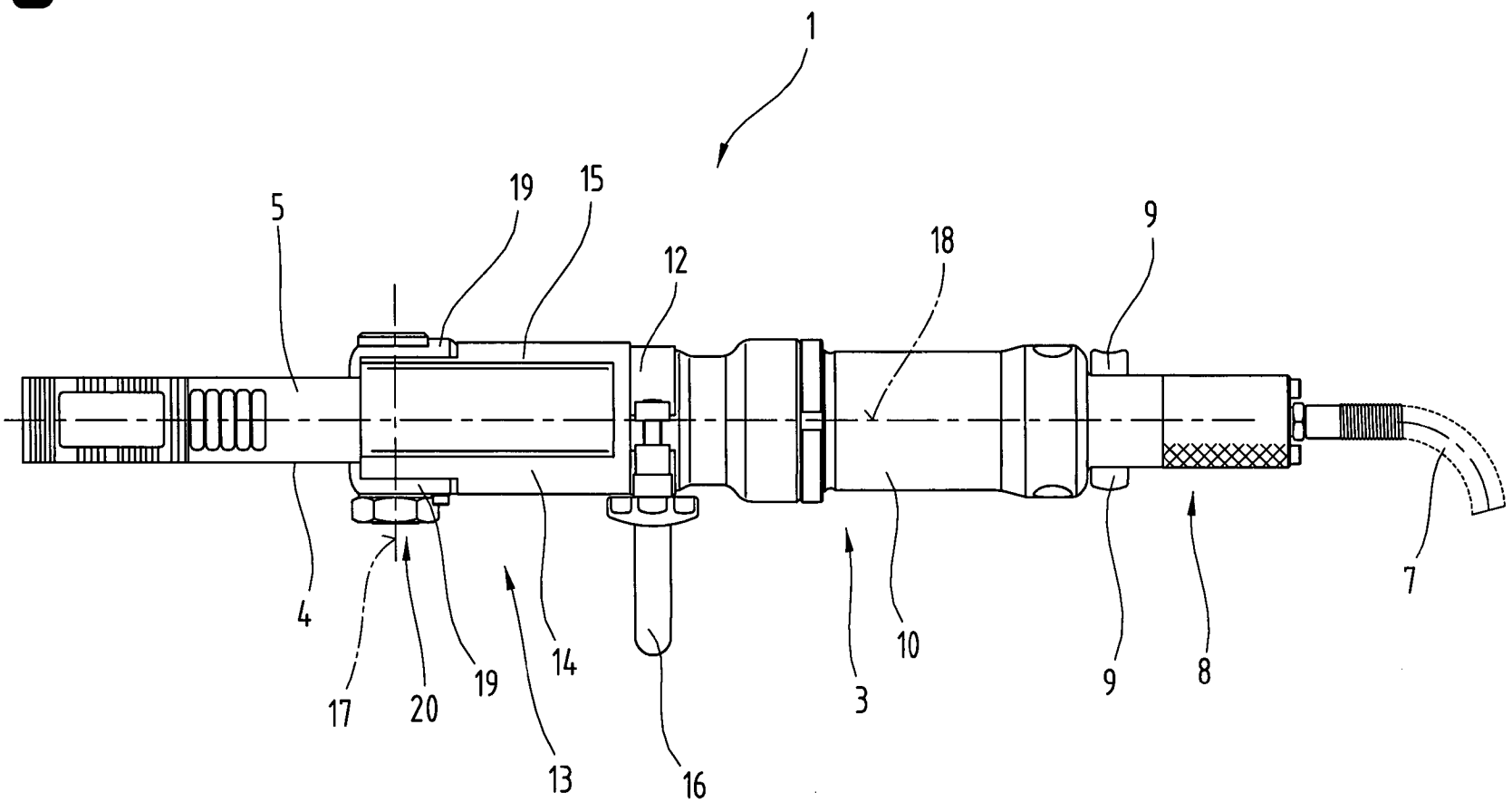
FIG. 2 is a side view of the rescue apparatus.

FIGS. 1 and 2 illustrate a rescue apparatus 1 with prising arms 4, 5 which can be displaced in a pincer-like movement on a cylindrical body 3 by means of a linear drive system 2.

In the embodiment illustrated as an example, the drive system 2 comprises a hydraulic cylinder 10 which can be operated by means of a hydraulic unit 6 via incoming and outgoing lines 7, and a tubular handle 8 with integrated control means 9 with an actuator means 11 which can be displaced in a linear direction.

Disposed on a terminal flange 12 of the hydraulic cylinder 10 through which the actuator means 11 extends is a bearing housing 13, which essentially comprises two bearing plates 14, disposed parallel at a distance apart from one another. The support housing 3 preferably also has a carrying handle 16, which is preferably disposed spaced apart from the latter and surrounding it.

Disposed on the bearing plates 14, 15 are pivot bearings 19 of a pivot bearing arrangement 20 for the prising arms 4, 5 constituting a pivot axis 17 which extends perpendicular to a longitudinal mid-axis 18 of the cylindrical body 3, in which the prising arms 4, 5 are mounted so as to pivot about the pivot axis 17—indicated by double arrow 21. A drive connection is established between the linearly displaceable actuator means 11 of the hydraulic cylinder 10 and the prising arms 4, 5 by means of transmission levers 22, 23 articulatingly connected to the actuator means 10 and one of the respective prising arms 4, 5.

Due to an eccentric disposition of pivot bearings 24, 25 with respect to the longitudinal mid-axis 18, in which the transmission levers 22, 23 are articulatingly connected to the prising arms 4, 5, the linear displacement of the actuator means 11 is converted into a pivoting movement of the prising arms 4, 5 when the actuator means 11 is displaced, and when the actuator means 11 is extracted, the 4, 5 are moved towards one another and when the actuator means 11 is retracted, the prising arms 4, 5 are moved into an open position.

Based on the design of the lever geometry, a displacement path of the actuator means 11 is such that when the actuator means 11 is in the extracted end position, the internal surfaces 26, 27 extend in alignment with the longitudinal mid-axis 18. When the prising arms 4, 5 are in an open position, the internal surfaces 26, 27 subtend an angle 28 of approximately 75° to 90°.

This design enables a crushing force to be applied by the rescue apparatus 1 to an object, not illustrated, disposed between the oppositely lying internal surfaces 26, 27 when the prising arms 4, 5 are moved in the direction of the longitudinal mid-axis 18, as well as an expanding force by means of opposing external surfaces 29, 30 of the prising arms 4, 5 when the prising arms 4, 5 are moved into an open position.

The rescue apparatus 1 is therefore suitable for rescuing persons from a vehicle interior of a vehicle involved in an accident, who, because of the deformation which has occurred to the vehicle body, can only be accessed by applying extreme force to create openings, e.g. by crushing parts of the bodywork or by prising open objects such as doors, roof openings, etc.

Figure 3:
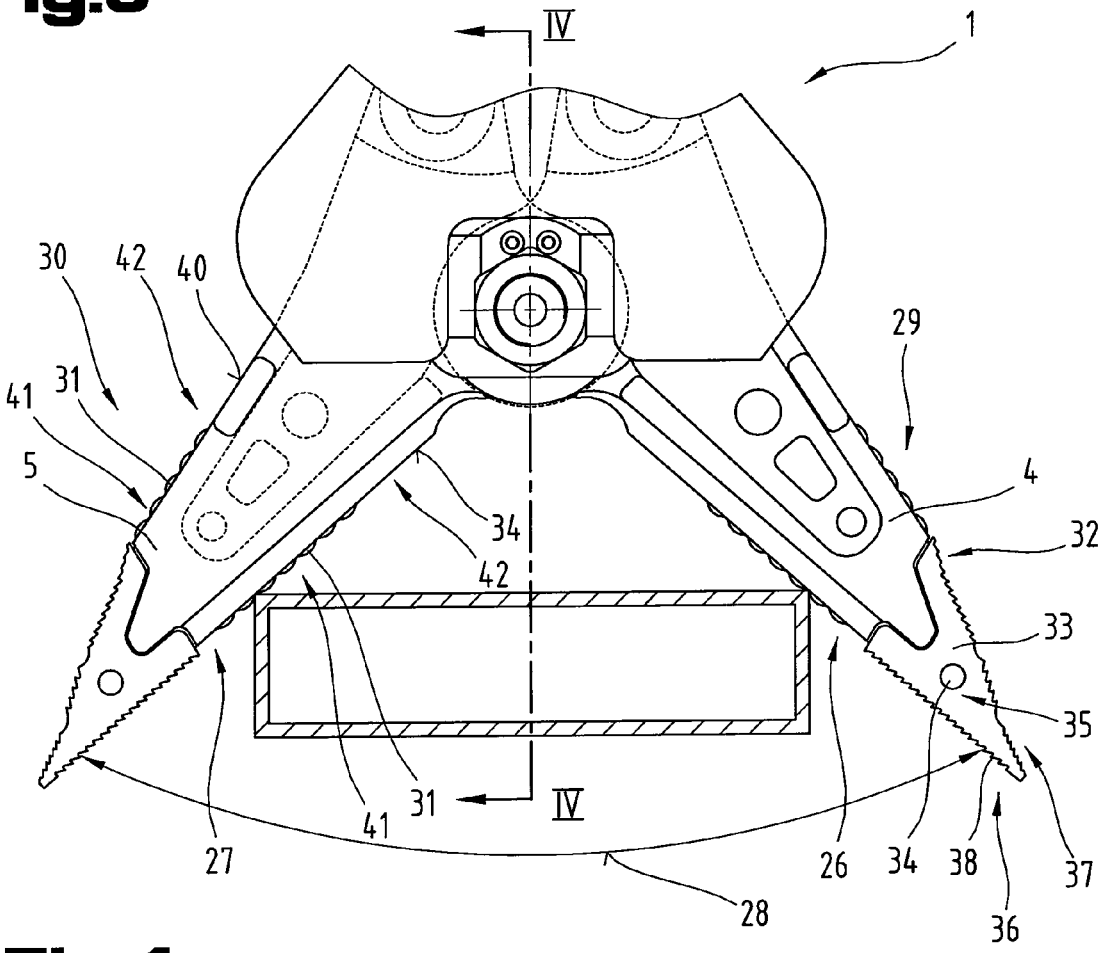
FIG. 3 is a detailed diagram illustrating a front view of the rescue apparatus.
Figure 4:
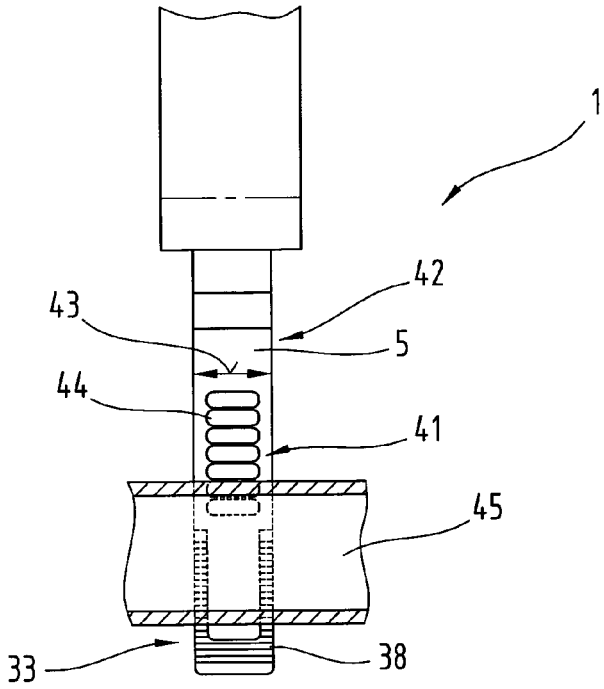
FIG. 4 is a detailed diagram showing a section along line IV-IV indicated in FIG. 3.

FIGS. 3 and 4 provide detailed illustrations of an embodiment of the prising arms 4, 5 of the rescue apparatus 1 proposed by the invention.

In the case of this embodiment, the prising arms 4, 5 are parts forged from blanks made from a high-strength Al alloy in a forging press, thereby resulting in a high final quality requiring little finishing work. The choice of material simultaneously results in a high mechanical strength in terms of transmitting strong forces such as needed in applications involving the rescue apparatus 1. In addition to high resistance to deformation, however, it is also very important to ensure that the attacking surfaces of the prising arms 4, 5 have a high resistance to wear if they are to have a long, problem-free service life, and that they do not slip off parts of the object on which the prising arms 4, 5 are positioned.

Solutions known from the prior art as a means of preventing such slipping involve providing rib-type raised areas 31 on the internal surfaces 26, 27 and optionally also on the external surfaces 29, 30, and in terms of durability, these have the same predefined wear resistance as the material used for the prising arms 4, 5, which means that their service life is short as a result of wear.

Another approach known from the prior art is to attach manually releasable prising tips 33 to outwardly projecting end regions 32, as illustrated here for example. These are preferably made from high-strength, wear-resistant and preferably heat-treated material. They are designed for different uses and manually removable bolts 34 are used as fixing means 35 to enable them to be changed rapidly. To enable high forces to be transmitted, a positive connection is also provided between the end regions 32 of the prising arms 4, 5 and the prising tips 33.

Parallel toothing 38 is also provided on opposing attacking surfaces 36, 37 of the prising tip 34 to prevent slippage during use.

At the internal surfaces 26, 27 and external surfaces 29, 30, the prising arms 4, 5 are provided with surface regions 41 which have a higher resistance to wear than adjacent regions 42, due to the fact that hard materials are incorporated in the material of the prising arms 4, 5 in these surface regions 41 by means of a laser dispersing process known from the prior art, thereby resulting in increased resistance to wear.

The raised areas 31 in the form of ribs 44 standing proud of the surfaces 39, 40 are provided in these surface regions 41, preferably extending in the direction of and through a part of a thickness 43 and parallel with one another, and it is because of the increase in volume of the base material of the prising arms 4, 5 achieved by incorporating hard material that the resistance to slipping and higher resistance to wear is achieved in this surface region 41.

The ribs 44 already guarantee more reliable gripping of an object 44 due to a bigger angle 28 of the oppositely lying internal faces 26, 27. The same applies to the surface regions 41 provided on the external surfaces 29, 30, which are also treated by means of a laser dispersing process and are also preferably provided with ribs 44.

In addition to the slip resistance achieved by means of the ribs 44, the deforming operation needed to deform an object by crushing is speeded up as a result of a higher surface load achieved due to the linear contact of the ribs 44 with the object 45.

The surface regions 41 at the internal surfaces 26, 27 and optionally at the external surfaces 29, 30 extend in the longitudinal direction of the prising arms 4, 5 across a part of the surfaces 39, 40 between the finger projections 33 and the bearing housing 13.

Figure 5:
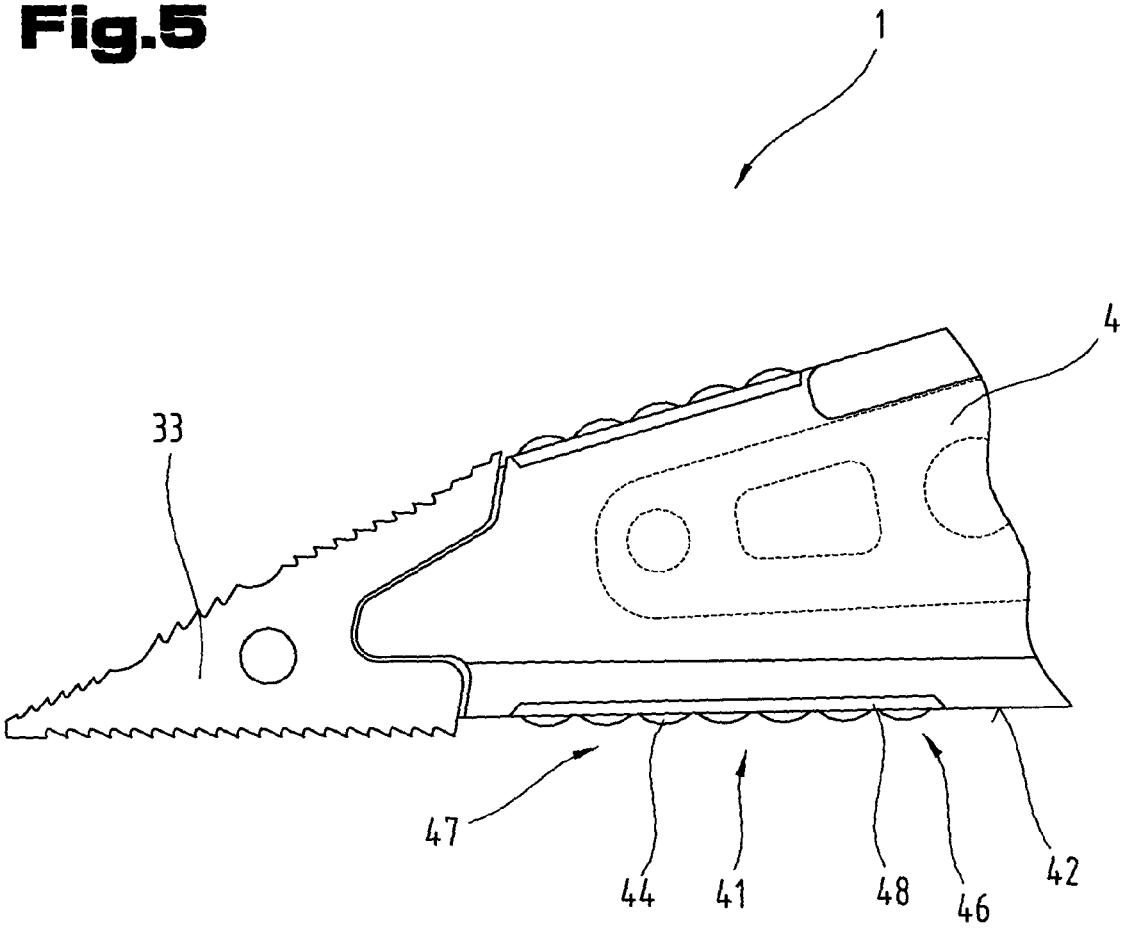
FIG. 5 illustrates another embodiment of a prising arm of the rescue apparatus proposed by the invention.

FIG. 5 illustrates another embodiment of the rescue apparatus 1, the same reference numbers and component names being used to denote parts that are the same as those described in connection with FIGS. 1 to 4 above. To avoid unnecessary repetition, reference may be made to the detailed description of FIGS. 1 to 4 above. In this embodiment, the ribs 44 in the surface regions 41 of the prising arms 4, 5 with a higher resistance to wear than adjacent regions 42 are—as described above—disposed parallel and spaced slightly apart from one another and preferably extend across a partial region of the thickness of the prising arm 4.

Immediately at the start of deforming an object, not illustrated in detail, the ribs 44 are pressed into the object, irrespective of whether a crushing or prising operation is taking place, thereby enabling the object 45 to be gripped without slipping.

In the embodiment illustrated as an example here, the surface region 41, may be designed as an applied layer 46, optionally incorporating the ribs 44, e.g. a hard metal layer 47. It is applied in a process using an arc or flame, for example, and the hard metal layer 47 is preferably applied to a compensating layer 48 applied beforehand in the surface region 41 of the prising arm 4, 5 to prevent embrittlement or tearing in the Al matrix of the prising arm 4, 5.

The embodiments illustrated as examples represent possible variants of the rescue apparatus, and it should be pointed out at this stage that the invention is not specifically limited to the variants specifically illustrated, and instead the individual variants may be used in different combinations with one another and these possible variations lie within the reach of the person skilled in this technical field given the disclosed technical teaching. Accordingly, all conceivable variants which can be obtained by combining individual details of the variants described and illustrated are possible and fall within the scope of the invention.

For the sake of good order, finally, it should be pointed out that, in order to provide a clearer understanding of the structure of the rescue apparatus 1, it and its constituent parts are illustrated to a certain extent out of scale and/or on an enlarged scale and/or on a reduced scale.

The objective underlying the independent inventive solutions may be found in the description.

Above all, the individual embodiments of the subject matter illustrated in FIGS. 1, 2; 3, 4; 5 constitute independent solutions proposed by the invention in their own right. The objectives and associated solutions proposed by the invention may be found in the detailed descriptions of these drawings.

| List of reference numbers | |
|---|---|
| 1 | Rescue apparatus |
| 2 | Drive system |
| 3 | Support housing |
| 4 | Prising arm |
| 5 | Prising arm |
| 6 | Hydraulic unit |
| 7 | Incoming and outgoing line |
| 8 | Handle |
| 9 | Control means |
| 10 | Hydraulic cylinder |
| 11 | Actuator means |
| 12 | Terminal flange |
| 13 | Bearing housing |
| 14 | Bearing plate |
| 15 | Bearing plate |
| 16 | Carrying handle |
| 17 | Pivot axis |
| 18 | Longitudinal mid-axis |
| 19 | Pivot bearing |
| 20 | Pivot bearing arrangement |
| 21 | Double arrow |
| 22 | Transmission lever |
| 23 | Transmission lever |
| 24 | Pivot bearing |
| 25 | Pivot bearing |
| 26 | Internal surface |
| 27 | Internal surface |
| 28 | Angle |
| 29 | External surface |
| 30 | External surface |
| 31 | Raised areas |
| 32 | End region |
| 33 | Finger projection |
| 34 | Bolt |
| 35 | Fixing means |
| 36 | Attacking surface |
| 37 | Attacking surface |
| 38 | Toothing |
| 39 | Surface |
| 40 | Surface |
| 41 | Surface region |

-continued

| List of reference numbers | |
|---|---|
| 42 | Region |
| 43 | Thickness |
| 44 | Rib |
| 45 | Object |
| 46 | Applied layer |
| 47 | Hard metal layer |
| 48 | Compensating layer. |

The invention claimed is:

1. Rescue apparatus comprising prising arms having mutually facing external and internal surfaces and including prising tips on a distal end of the arms with a serrated surface on a cylindrical body mounted in at least one pivot bearing arrangement with a drive system which is being displaced in a pincer-type movement about a pivot axis extending perpendicular to a longitudinal mid-axis of a support housing, wherein at least surface regions on at least the mutually facing internal surfaces of the prising arms have a resistance to wear that is higher than the resistance to wear of adjacent regions of the prising arms, and the surface regions comprise hard substances introduced into the base material of the prising arms, wherein the surface regions with a higher wear resistance include rib-type raised areas, wherein the raised areas are provided in the form of ribs in the surface regions extending parallel with one another in the direction of a thickness of the prising arms, said ribs project beyond or protrude from at least the internal surfaces, wherein the prising arms comprise die-forged parts made from an aluminum alloy, and wherein a peripheral layer of the ribs is made from the aluminum alloy of the prising arms and hard substances are incorporated into an aluminum alloy matrix thereof having a base of oxide, carbide or nitride, wherein the hard substances are introduced to form the peripheral layer of the prising arm by means of a laser dispersing operation.

2. Rescue apparatus as claimed in claim 1, wherein raised areas of the surface regions are arranged on mutually opposing external surfaces of the prising arms have a higher resistance to wear.

3. Rescue apparatus as claimed in claim 1, wherein the prising tips are made from heat-treated tool steel; and, wherein the prising tips are releasably connected to said prising arms.

4. Rescue apparatus as claimed in claim 1, wherein the ribs extend across a partial region of the prising arms.

5. Rescue apparatus as claimed in claim 1, wherein a rib height is between 0.05 mm and 1.0 mm.

6. Rescue apparatus as claimed in claim 1, wherein the ribs have an approximately semi-circular cross-section.

7. Rescue apparatus as claimed in claim 1, wherein the ribs are spaced at a distance apart from one another in the surface region.

* * * * *